US012031244B2

(12) United States Patent
Hosotani et al.

(10) Patent No.: US 12,031,244 B2
(45) Date of Patent: Jul. 9, 2024

(54) OXIDATION HEAT TREATMENT OVEN AND METHOD FOR MANUFACTURING OXIDIZED FIBER BUNDLE AND CARBON FIBER BUNDLE

(71) Applicant: Toray Industries, Inc., Tokyo (JP)

(72) Inventors: Naoto Hosotani, Ehime (JP); Taku Yamamoto, Otsu (JP); Kazuyuki Gondo, Otsu (JP); Shigeki Chieda, Nasushiobara (JP); Toru Nishikawa, Otsu (JP); Fumiyasu Nomura, Otsu (JP)

(73) Assignee: TORAY INDUSTRIES, INC., Tokyo (JP)

( * ) Notice: Subject to any disclaimer, the term of this patent is extended or adjusted under 35 U.S.C. 154(b) by 455 days.

(21) Appl. No.: 17/438,127

(22) PCT Filed: Jan. 29, 2020

(86) PCT No.: PCT/JP2020/003057
§ 371 (c)(1),
(2) Date: Sep. 10, 2021

(87) PCT Pub. No.: WO2020/189029
PCT Pub. Date: Sep. 24, 2020

(65) Prior Publication Data

US 2022/0162776 A1 May 26, 2022

(30) Foreign Application Priority Data

Mar. 19, 2019 (JP) ..... 2019-050792

(51) Int. Cl.
*D01F 9/32* (2006.01)
*D01F 9/21* (2006.01)

(52) U.S. Cl.
CPC ..... *D01F 9/328* (2013.01); *D01F 9/21* (2013.01); *D01F 9/32* (2013.01)

(58) Field of Classification Search
CPC ... D01F 9/21; D01F 9/22; D01F 9/225; D01F 9/32; D01F 9/328
See application file for complete search history.

(56) References Cited

U.S. PATENT DOCUMENTS

| | | | |
|---|---|---|---|
| 7,335,018 | B2 | 2/2008 | Yamaguchi |
| 9,834,869 | B2 | 12/2017 | Kaji et al. |
| 10,472,738 | B2 | 11/2019 | Arai et al. |

FOREIGN PATENT DOCUMENTS

| | | | |
|---|---|---|---|
| JP | 2002194627 | A | 7/2002 |
| JP | 2004027414 | A | 1/2004 |

(Continued)

OTHER PUBLICATIONS

International Search Report and Written Opinion for International Application No. PCT/JP2020/003057, dated Mar. 31, 2020, 6 pages.

*Primary Examiner* — Jerzi H Moreno Hernandez
(74) *Attorney, Agent, or Firm* — RATNERPRESTIA

(57) ABSTRACT

There is provided an oxidation heat treatment oven including a heat treatment chamber configured to heat-treat a fiber bundle that is an aligned acrylic fiber bundle in an oxidizing atmosphere to form an oxidized fiber bundle; a slit-shaped opening configured to take the fiber bundle in and out of the heat treatment chamber; guide rollers installed at both ends of the heat treatment chamber and configured to turn the fiber bundle back; a hot air supply nozzle that has a longitudinal axis along the width of the fiber bundle traveling and that blows out hot air, in a direction substantially parallel to a traveling direction of the fiber bundle, above and/or below the fiber bundle traveling in the heat treatment chamber; and a suction nozzle configured to suck the hot air (Continued)

blown out from the hot air supply nozzle, in which the hot air supply nozzle satisfies disclosed conditions (1) to (3).

11 Claims, 10 Drawing Sheets

(56) References Cited

FOREIGN PATENT DOCUMENTS

| | | | |
|---|---|---|---|
| JP | 2004124310 | A | 4/2004 |
| JP | 5682626 | A | 3/2015 |
| JP | 5812205 | B2 | 11/2015 |
| WO | 02077337 | A1 | 10/2002 |

(a)

(b)

OXIDATION HEAT TREATMENT OVEN AND METHOD FOR MANUFACTURING OXIDIZED FIBER BUNDLE AND CARBON FIBER BUNDLE

CROSS REFERENCE TO RELATED APPLICATIONS

This is the U.S. National Phase application of PCT/JP2020/003057, filed Jan. 29, 2020, which claims priority to Japanese Patent Application No. 2019-050792, filed Mar. 19, 2019 the disclosures of each of these applications being incorporated herein by reference in their entireties for all purposes.

FIELD OF THE INVENTION

The present invention relates to an apparatus for manufacturing an oxidized fiber bundle. More specifically, the present invention relates to an apparatus for manufacturing an oxidized fiber bundle, the apparatus being capable of efficiently manufacturing an oxidized fiber bundle with homogeneous physical properties and high quality without operational trouble.

BACKGROUND OF THE INVENTION

Since carbon fibers are excellent in specific strength, specific elastic modulus, heat resistance, and chemical resistance, they are useful as reinforcing materials for various materials and are used in a wide range of fields such as aerospace applications, leisure applications, and general industrial applications.

In general, as a method for manufacturing a carbon fiber bundle from an acrylic fiber bundle, there is known a method in which (i) a fiber bundle obtained by bundling thousands to tens of thousands of single fibers of an acrylic polymer is fed into an oxidation oven, and heat-treated (oxidation-treated) by exposing the fiber bundle to hot air of an oxidizing atmosphere, such as air heated to 200 to 300° C. supplied from a hot air supply nozzle installed in the oven, and subsequently, (ii) the obtained oxidized fiber bundle is fed into a carbonization oven, and heat-treated (pre-carbonized) in an inert gas atmosphere of 300 to 1,000° C., and then (iii) further heat-treated (carbonized) in a carbonization oven filled with an inert gas atmosphere of 1,000° C. or higher. In addition, the oxidized fiber bundle as an intermediate material is also widely used as a material for a flame-retardant woven fabric by taking advantage of its flame-retardant performance.

In the carbon fiber bundle manufacturing process, the oxidation process (i) described above has the longest treatment time and the largest amount of energy consumed. Therefore, it is most important in manufacturing the carbon fiber bundle to keep the quality of the obtained oxidized fiber bundle uniform while improving the productivity in the oxidation process.

In the oxidation process, in order to enable long time heat treatment, an apparatus for performing oxidation (hereinafter, referred to as an oxidation oven) generally performs oxidation treatment by hot air supplied into the oven while horizontally reciprocating acrylic fibers many times with direction-changing rollers arranged outside the oxidation oven. In this case, the reaction heat generated by the oxidation reaction of the fiber bundle is removed by hot air supplied into the oven, thus controlling the reaction. A system of supplying hot air in a direction substantially parallel to the traveling direction of the fiber bundle is generally referred to as a parallel flow system, and a system of supplying hot air in a direction perpendicular to the traveling direction of the fiber bundle is generally referred to as an perpendicular flow system. The parallel flow system includes an end-to-end hot air system in which a hot air supply nozzle is installed at an end portion of a parallel flow oven (oxidation oven) and a suction nozzle is installed at the opposite end portion, and a center-to-end hot air system in which a hot air supply nozzle is installed at a center portion of a parallel flow oven and suction nozzles are installed at both end portions.

As a means for improving productivity in the above oxidation process, it is effective to increase the density of the fiber bundles in the oxidation oven by increasing the width of the passage path for the fiber bundle to increase the number of the fiber bundles passing through the oxidation oven, or, even if the width of the passage path for the fiber bundle is remained the same, by conveying a large number of fiber bundles at the same time. Thereby, the treatment amount per unit time can be increased.

However, when the width of the passage path for the fiber bundle is increased, the width of the hot air supply nozzle is inevitably increased, so that it is difficult to maintain the uniformity of the air speed distribution along the width of the hot air supply port by a simple flow rectification method. Thus, unevenness is generated in heat removing performance by hot air, so that unevenness is also generated in the oxidation reaction, and finally, quality unevenness of the product occurs.

When the density of the fiber bundles in the oxidation oven is increased, the distance between adjacent fiber bundles becomes short. If the air speed distribution of hot air is therefore non-uniform, the fiber bundle traveling in the oven swings due to the influence of disturbance such as variation in drag received from the hot air, and the contact frequency between adjacent fiber bundles increases. As a result, mixing of fiber bundles, breakage of single fibers, and the like frequently occur, leading to deterioration of the quality of the oxidized fiber.

Therefore, there has been a problem that it is necessary to maintain uniformity of the air speed distribution along the width of the hot air supply port in order to keep the quality of the obtained oxidized fiber bundle uniform while improving productivity in the oxidation process.

In order to solve the above problem, Patent Document 1 describes that, in a heat treatment oven in which a hot air introduction region including a guide blade, a perforated plate, and a flow rectification plate, when the dimensions of each part in the heat treatment oven are defined in a predetermined relationship, the air speed unevenness along the width of the nozzle at a position 1 m downstream from the nozzle blowout surface is ±7% with respect to an average air speed of 3.0 m/s in the heat treatment chamber. In addition, Patent Document 2 describes that, in a gas supply nozzle that is provided with a guide plate, the guide plate being provided in a gas guide portion that is a space provided between a gas introduction port and a flow rectification plate portion and being configured to divide gas supplied from the introduction port into two or more flows and guide the gas to the flow rectification plate portion, the flow path width between the guide plates is defined in a predetermined relationship, by which an air speed unevenness along the width of the nozzle at a position 2 m downstream from the nozzle blowout surface is ±5% with respect to an average air speed of 3.0 m/s in the heat treatment chamber. Further, Patent Document 3 describes that, by defining not only the relationship between the dimensions of parts of a hot air blowout nozzle including a perforated plate and a flow rectification member but also the opening ratio and the diameter of the perforated plate, the air speed unevenness along the width of the nozzle at a position 2 m downstream from the nozzle blowout surface is ±5% with respect to an average air speed of 3.0 m/s in the heat treatment chamber.

PATENT DOCUMENTS

Patent Document 1: Japanese Patent Laid-open Publication No. 2002-194627
Patent Document 2: Japanese Patent No. 5812205
Patent Document 3: Japanese Patent No. 5682626

SUMMARY OF THE INVENTION

In Patent Documents 1 and 2, however, a member for controlling the direction of an air flow, such as the guide blade or the guide plate, is used in order to reduce the air speed unevenness, and in order to obtain a desired air speed distribution, it is necessary to increase the nozzle length along the traveling direction of a fiber bundle by a certain length or more. Therefore, in the space sandwiched between the nozzles where the fiber bundle travels, the space in which hot air does not flow becomes large, and the risk of occurrence of runaway reaction caused by insufficient heat removal for the fiber bundle in which an exothermic reaction occurs is increased.

In addition, Patent Document 3 describes that the air speed unevenness is ±5% with respect to an average air speed of 3.0 m/s in the heat treatment chamber, but this is a measurement result at a position 2 m apart from the nozzle blowout surface, that is, a position where the blown gas is leveled to some extent. According to the findings of the present inventors, the most important factor for the swing of a fiber bundle caused by air speed unevenness is the air speed distribution in the vicinity of a nozzle blowout surface, and this point is not sufficiently studied in the prior art documents.

Therefore, an object of the present invention is to provide a method for efficiently producing an oxidized fiber bundle and a carbon fiber bundle that have homogeneous physical properties and high quality without operational trouble.

An oxidation heat treatment oven according to an embodiment of the present invention to solve the above problems is an oxidation heat treatment oven including a heat treatment chamber configured to heat-treat a fiber bundle that is an aligned acrylic fiber bundle in an oxidizing atmosphere to form an oxidized fiber bundle; a slit-shaped opening configured to take the fiber bundle in and out of the heat treatment chamber; guide rollers installed at both ends of the heat treatment chamber and configured to turn the fiber bundle back; a hot air supply nozzle that has a longitudinal axis along the width of the fiber bundle traveling and that blows out hot air, in a direction substantially parallel to a traveling direction of the fiber bundle, above and/or below the fiber bundle traveling in the heat treatment chamber; and a suction nozzle configured to suck the hot air blown out from the hot air supply nozzle, in which the hot air supply nozzle satisfies conditions (1) to (3) described below.

(1) The hot air supply nozzle includes a hot air introduction port configured to supply hot air along the longitudinal axis of the hot air supply nozzle; a hot air supply port configured to blow out the hot air in the direction substantially parallel to the traveling direction of the fiber bundle; and one or more stabilization chambers located between the hot air introduction port and the hot air supply port, in which the hot air introduction port and the hot air supply port communicate with each other via the one or more stabilization chambers.

(2) At least one of the stabilization chambers includes a partition plate provided on a downstream side of a hot air flow path; a plurality of cylindrical bodies each having openings at both ends and connected to a surface of the partition plate on an upstream side of the hot air flow path such that the axis orientation of each of the cylindrical bodies is perpendicular to the longitudinal axis of the hot air supply nozzle; and a gas flow hole provided at a surface of each of the cylindrical bodies in contact with the partition plate and configured to penetrate through the partition plate.

(3) In the cylindrical bodies, an angle θ formed by the partition plate and a wall that is one of walls rising from the partition plate and on a side close to the hot air introduction port is in a range of 60° or more and 110° or less as an internal angle in a cross-sectional shape of the cylindrical bodies.

Here, the "direction substantially parallel to the traveling direction of the fiber bundle" in an embodiment of the present invention refers to a direction within a range of ±0.7° with respect to a horizontal line between vertexes of a pair of facing direction-changing rollers (that is, guide rollers) disposed at both ends of the heat treatment chamber.

The "guide rollers installed at both ends of the heat treatment chamber and configured to turn the fiber bundle back" in an embodiment of the present invention means guide rollers that enables the fiber bundle to travel in multiple stages in the heat treatment chamber while turning the fiber bundle back, and their rotation shafts may be supported inside or outside the heat treatment chamber.

In addition, a method for manufacturing an oxidized fiber bundle according to an embodiment of the present invention is a method for manufacturing the oxidized fiber bundle by using the above-described oxidation heat treatment oven to manufacture the oxidized fiber bundle, the method including allowing an aligned acrylic fiber bundle to travel while turning the acrylic fiber bundle back with guide rollers installed at both ends of a heat treatment chamber; and heat-treating the fiber bundle in an oxidizing atmosphere in the heat treatment chamber by hot air blown out from a hot air supply nozzle, in a direction substantially parallel to a traveling direction of the fiber bundle, above and/or below the fiber bundle traveling in the heat treatment chamber while sucking the hot air with a suction nozzle.

In addition, the method for manufacturing a carbon fiber bundle according to an embodiment of the present invention is a method for manufacturing the carbon fiber bundle, including pre-carbonizing the oxidized fiber bundle manufactured by the above-described method for manufacturing an oxidized fiber bundle at a maximum temperature of 300 to 1,000° C. in an inert gas to obtain a pre-carbonized fiber bundle, and then carbonizing the pre-carbonized fiber bundle at a maximum temperature of 1,000 to 2,000° C. in an inert gas.

According to an embodiment of the present invention, by uniformizing the flow speed distribution of hot air in the vicinity of the blowout surface of a hot air supply nozzle, an oxidized fiber bundle having uniform physical properties and high quality can be efficiently produced without operational trouble.

DETAILED DESCRIPTION OF EMBODIMENTS OF THE INVENTION

Figure 1:
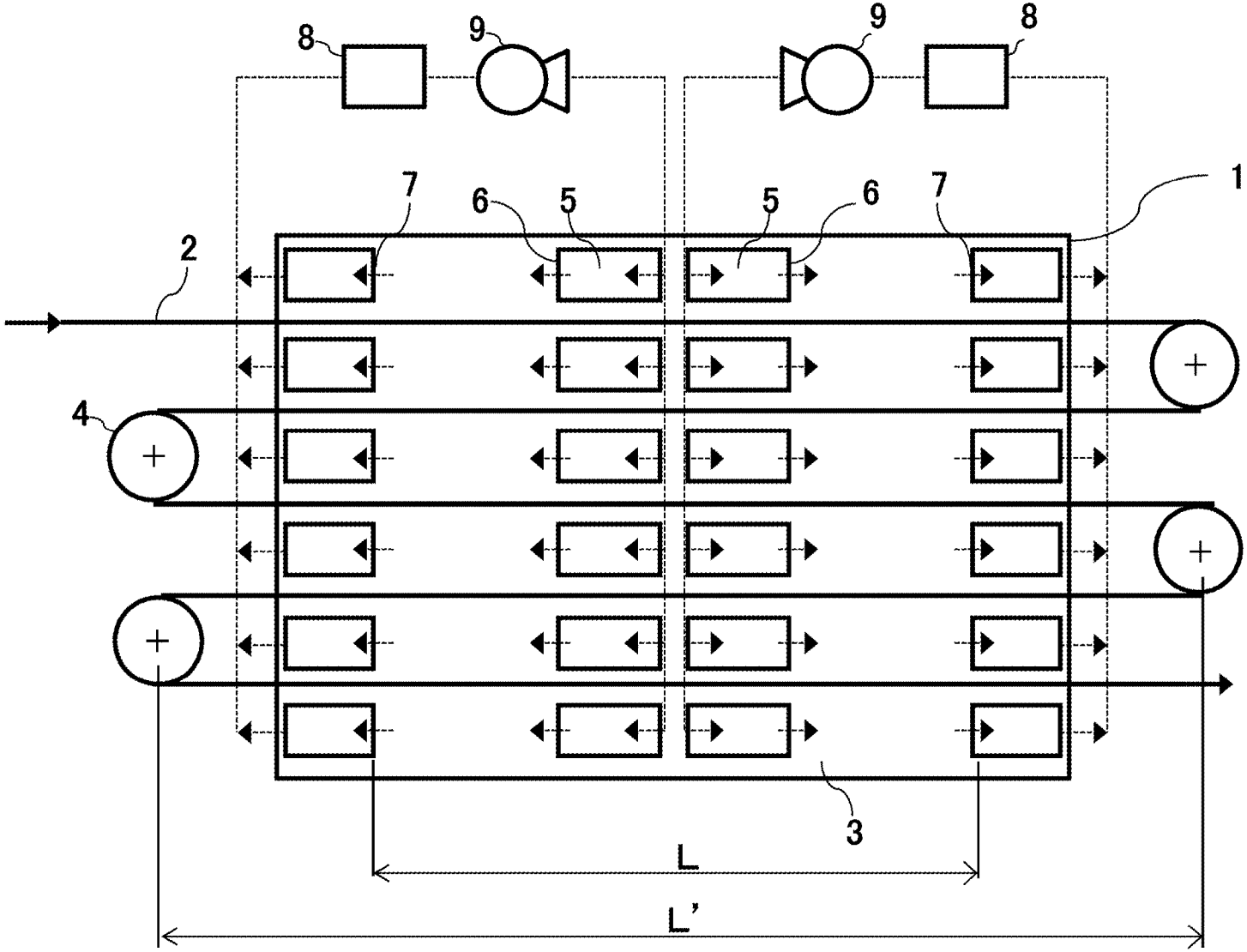
FIG. 1 is a schematic cross-sectional view of an oxidation heat treatment oven used in an embodiment of the present invention.

Hereinafter, embodiments of the present invention will be described in detail with reference to the drawings. FIG. 1 is a schematic cross-sectional view of an oxidation heat treatment oven (hereinafter, it may be referred to as an oxidation oven) used in a first embodiment of the present invention. Note that the drawings in the present specification are conceptual diagrams for accurately describing the main points of the present invention and are simplified diagrams. Therefore, the oxidation oven used in the present invention is not particularly limited to the aspects shown in the drawings, and its dimensions and the like, for example, can be changed according to an embodiment.

The present invention according to exemplary embodiments provides an apparatus for performing oxidation (oxidation oven) that heat-treats an acrylic fiber bundle in an oxidizing atmosphere. An oxidation oven 1 shown in FIG. 1 has a heat treatment chamber 3 that performs oxidation treatment by blowing hot air to an acrylic fiber bundle 2 traveling while turning back in a multistage traveling region. The acrylic fiber bundle 2 is fed into the heat treatment chamber 3 from a slit-shaped opening (not illustrated) provided in a side wall of the heat treatment chamber 3 of the oxidation oven 1, travels substantially linearly in the heat treatment chamber 3, and then is temporarily fed out of the heat treatment chamber 3 from a slit-shaped opening provided in the opposite side wall. Thereafter, the acrylic fiber bundle 2 is turned back by a guide roller 4 provided on the side wall outside the heat treatment chamber 3 and is fed into the heat treatment chamber 3 again. As described above, the traveling direction of the acrylic fiber bundle 2 is turned back a plurality of times by a plurality of the guide rollers 4, so that the acrylic fiber bundle 2 is repeatedly fed into and fed out of the heat treatment chamber 3 a plurality of times and moves in the heat treatment chamber 3 in multiple stages from the top to the bottom in FIG. 1 as a whole. The moving direction may be from the bottom to the top, and the number of times of turning the acrylic fiber bundle 2 back in the heat treatment chamber 3 is not particularly limited, which are appropriately designed according to the scale or the like of the oxidation oven 1. The guide roller 4 may be provided inside the heat treatment chamber 3.

The acrylic fiber bundle 2 is oxidation-treated by hot air flowing from a hot air supply nozzle 5 toward a hot air discharge port 7, during traveling inside the heat treatment chamber 3 while being turned back, to become an oxidized fiber bundle. The oxidation oven illustrated in FIG. 1 is a center-to-end hot air system oxidation oven of a parallel flow system as described above, but the present invention can also be preferably applied to an end-to-end hot air system. Note that the acrylic fiber bundle 2 has a wide sheet-like form in which a plurality of acrylic fiber bundles are aligned in parallel along the axis perpendicular to the paper plane of FIG. 1.

The oxidizing gas flowing in the heat treatment chamber 3 may be air or the like and is heated to a desired temperature by a heater 8 before entering the heat treatment chamber 3. After the air speed is controlled by a blower 9, the oxidizing gas is blown into the heat treatment chamber 3 from a hot air supply port 6 formed at a position that is lateral with respect to the longitudinal axis of the hot air supply nozzle 5. The oxidizing gas discharged from the hot air discharge port 7 of the hot air discharge nozzle to the outside of the heat treatment chamber 3 is released to the atmosphere after a toxic substance is treated in an exhaust gas treatment oven (not illustrated), but not all the oxidizing gas is necessarily treated, and a part of the oxidizing gas may be blown into the heat treatment chamber 3 from the hot air supply nozzle 5 again through a circulation path in an untreated state.

The heater 8 used in the oxidation oven 1 is not particularly limited as long as it has a desired heating function, and for example, a known heater such as an electric heater may be used. The blower 9 is also not particularly limited as long as it has a desired blowing function, and for example, a known blower such as an axial fan may be used.

The traveling speed and tension of the acrylic fiber bundle 2 can be controlled by changing the rotation speed of each of the guide rollers 4. The rotation speed of the guide roller 4 is fixed according to the required physical properties and treatment amount per unit time of the oxidized fiber bundle.

Further, by carving a predetermined interval and number of grooves in the surface layer of the guide roller 4, or by disposing a predetermined interval and number of comb guides (not illustrated) in the vicinity of the guide roller 4, it is possible to control the interval and the number of a plurality of the acrylic fiber bundles 2 traveling in parallel.

In order to increase the production amount, the width of the passage path for the fiber bundle may be widened, and the number of the fiber bundles passing through the oxidation oven may be increased. Alternatively, even if the width of the passage path for the fiber bundle is remained the same, the density of the fiber bundles in the oxidation oven may be increased by conveying a large number of fiber bundles at the same time. By the above manners, the treatment amount per unit time can be increased.

However, on the other hand, if the width of the passage path for the fiber bundle is increased, the width of the hot air supply nozzle inevitably increases. Therefore, it becomes difficult to maintain the uniformity of the air speed distribution along the width of the hot air supply port by the simple flow rectification method, and as described above, unevenness is generated in the heat removing performance by hot air, and as a result, unevenness is also generated in the oxidation reaction, by which quality unevenness of the product finally occurs.

If the density of the fiber bundles in the oven is increased, the distance between adjacent fiber bundles becomes short. Therefore, the air speed distribution of hot air is non-uniform, and in this case, the fiber bundles traveling in the oven swing due to the influence of disturbance such as variation in drag received from the hot air, and the contact frequency between adjacent fiber bundles increases. As a result, mixing of fiber bundles, breakage of single fibers, and the like frequently occur, leading to deterioration of the quality of the oxidized fiber.

Figure 2:
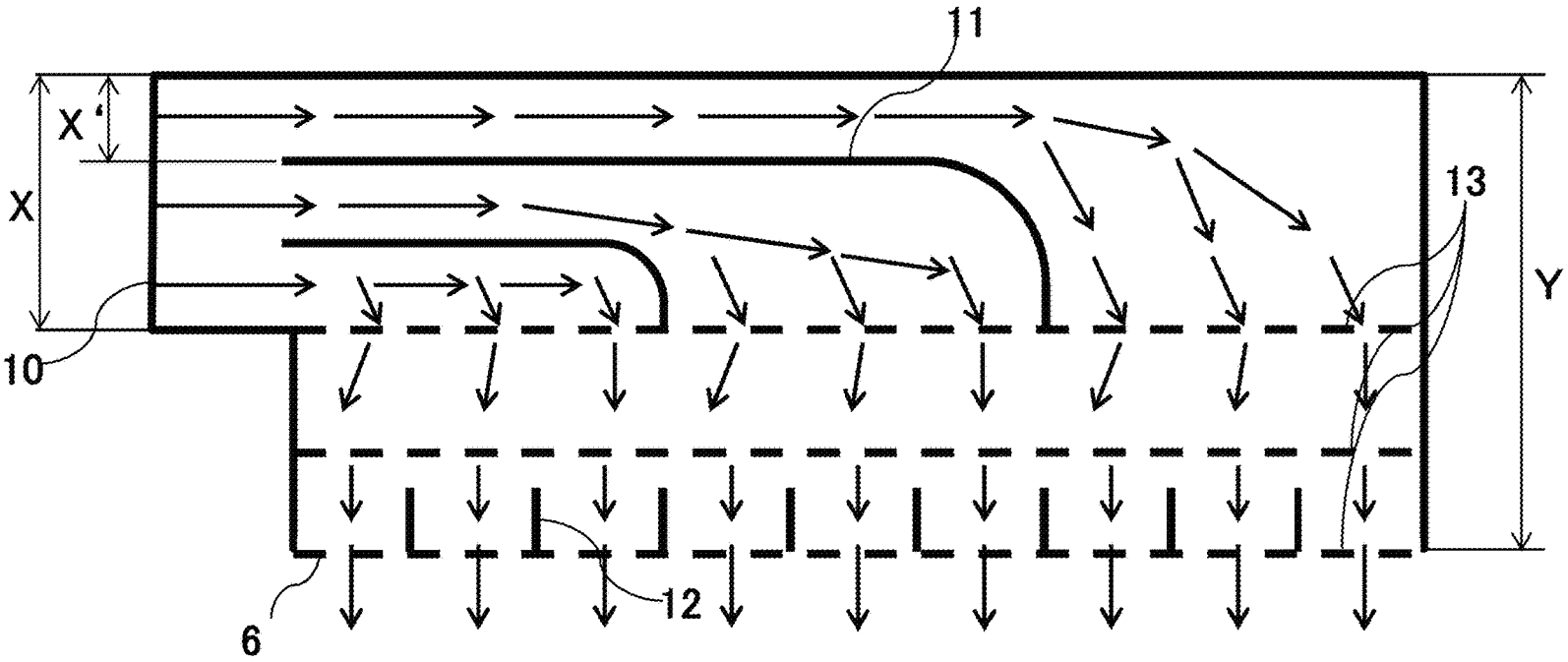
FIG. 2 is a cross-sectional view showing the configuration and flow path of a conventional hot air supply nozzle.
Figure 2:
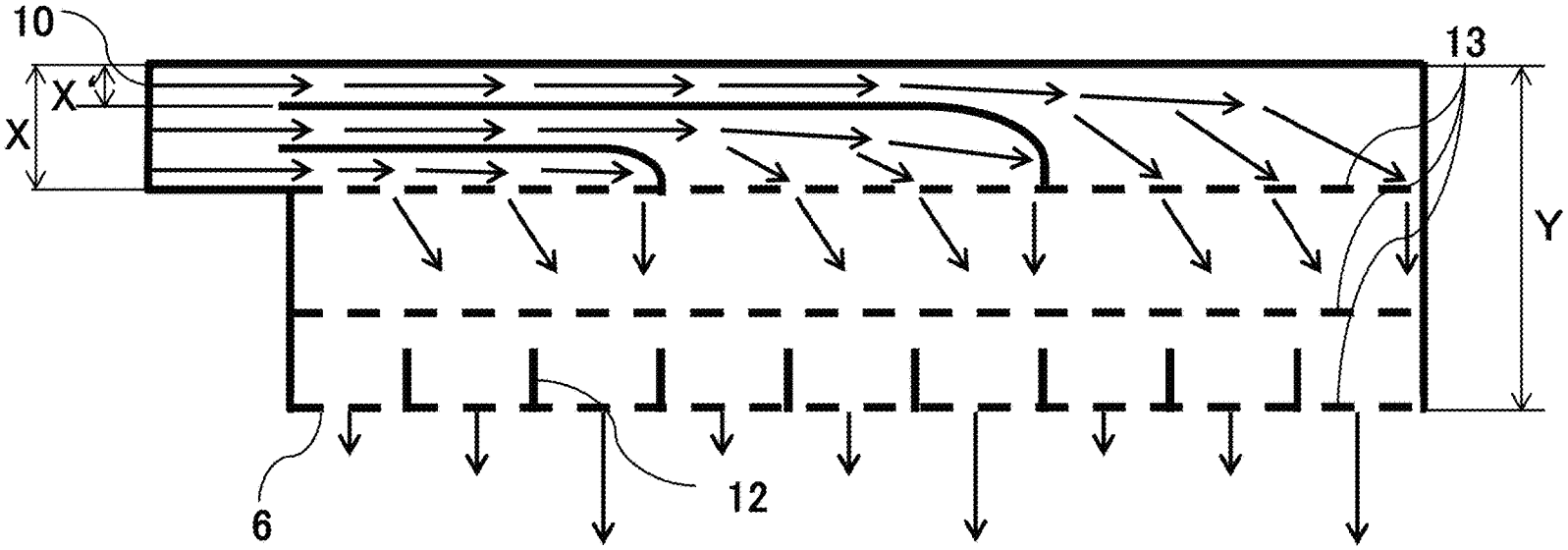

Therefore, in order to increase the production amount while keeping the quality of the oxidized fiber uniform, it is common to make the air speed of the hot air flowing in the heat treatment chamber 3 uniform, and for example, the conventional hot air supply nozzle 5 has a configuration as shown in FIGS. 2(*a*) and 2(*b*). In FIG. 2, the arrows indicate the flow direction of gas supplied from the hot air introduction port 10. In FIG. 2, the gas introduced from a hot air introduction port 10 into the hot air supply nozzle 5 through a circulation path so as to be perpendicular to the traveling direction of the fiber bundle undergoes a pressure loss by a perforated plate 13 while members such as a guide blade 11 and a flow rectification plate 12 controls the flowing direction, thereby the air speed distribution along the longitudinal axis of the nozzle (that is, along the width of the traveling fiber bundle) is made uniform. The member that causes the pressure loss is not limited to a perforated plate, and a honeycomb or the like may be disposed.

However, when the guide blade 11 is employed as a flow rectification member, it is necessary to increase the width X of the hot air introduction port 10 along the traveling direction of the fiber bundle by a certain value or more in order to obtain a desired air speed distribution. The reason for this is that, if the width X of the hot air introduction port 10 is reduced, the flow path width X' divided by the guide blade 11 is reduced; therefore, when comparing cases where the volumes of introduced air are the same, the smaller the divided flow path width X', the larger the air speed, and the stronger the inertial force in the gas introduction direction, that is, the direction perpendicular to the traveling direction of the fiber bundle; as a result, the flow of the gas is biased, and the air speed distribution becomes non-uniform along the longitudinal axis of the nozzle as indicated by the size of the arrows in FIG. 2(*b*).

As a method for controlling the non-uniform air speed distribution, it is conceivable to reduce the opening ratio and the opening diameter of the perforated plate 13, which, however, leads to an increase in equipment cost such as an increase in size of a fan with an increase in pressure loss. In addition, in order to avoid adhesion of oxidized fibers, for example, a method of applying an oil agent to a precursor fiber bundle is known, and especially, a silicone based oil agent is often used because it has high heat resistance and effectively suppresses the adhesion. A part of the silicone-based oil agent is volatilized due to high heat of the oxidation treatment, and dust is retained in hot air. Thereby, a perforated plate having a small pore diameter is clogged and blocked, and circulation of hot air is stagnated. When the circulation of hot air in the heat treatment chamber is stagnated, heat removal for the precursor fiber bundle is not smoothly performed, and yarn breakage of a precursor fiber bundle is induced. The precursor fiber bundle that has undergone yarn breakage induces yarn breakage of another precursor fiber bundle traveling in another traveling region by getting entangled or the like with another precursor fiber bundle, which becomes a cause of hindering stable operation of the oxidation oven, such as leading to fire in the worst case.

Therefore, in the flow rectification system of the conventional configuration, the nozzle length Y inevitably becomes long. If the nozzle length Y becomes long, a space becomes large in which hot air does not flow in a space sandwiched between nozzles that each apply hot air to each of the fiber bundles traveling in multiple stages, and the risk of occurrence of runaway reaction caused by insufficient heat removal for the fiber bundle in which an exothermic reaction occurs is increased.

The present inventors have therefore made intensive studies on these problems to find an oxidation oven having high air speed uniformity while shortening the nozzle length Y.

Figure 3:
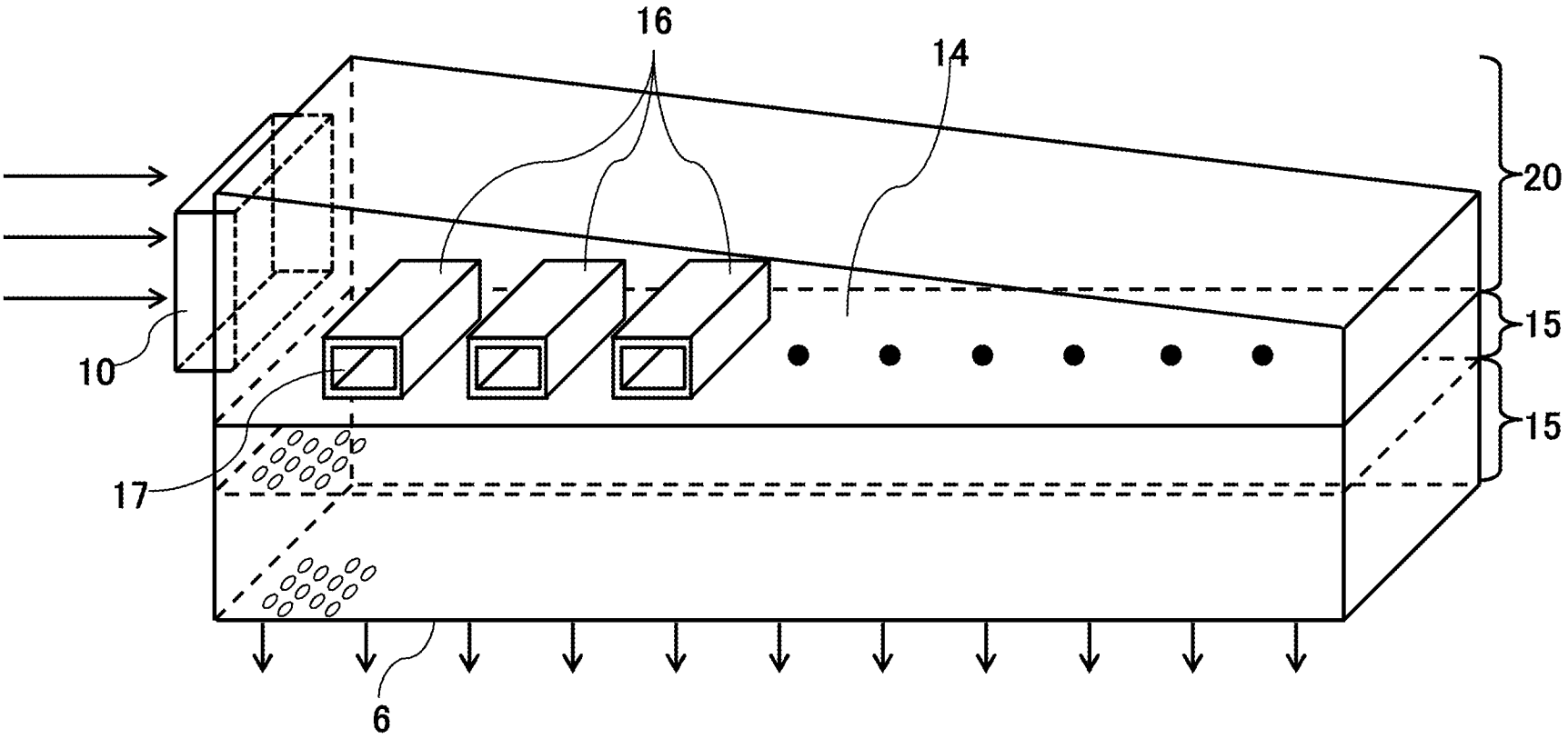
FIG. 3 is a schematic perspective view of the hot air supply nozzle shown in FIG. 1.
Figure 4:
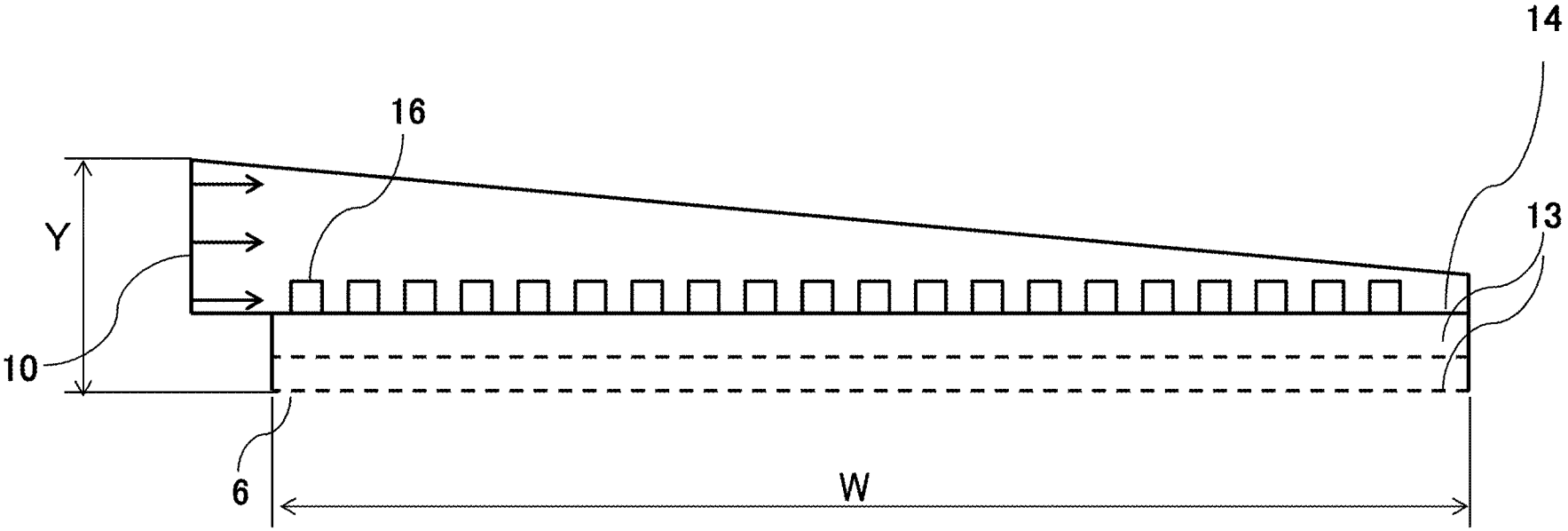
FIG. 4 is a cross-sectional view of the hot air supply nozzle shown in FIG. 3.

Hereinafter, a hot air supply nozzle disposed in the oxidation oven of according to an embodiment of the present invention will be described with reference to FIG. 3. FIG. 3 is a schematic perspective view for describing a configuration of the hot air supply nozzle in an embodiment of the present invention, and FIG. 4 is a cross-sectional view of the hot air supply nozzle 5. In the hot air supply nozzle shown in FIG. 3 and FIG. 4, a hot air flow path from the hot air introduction port 10 to the hot air supply port 6 (the perforated plate 13 itself in the configuration of FIGS. 3 and 4) is constituted by a plurality of stabilization chambers 15 partitioned by a partition plate 14 and the perforated plates 13. Here, the "stabilization chamber" in embodiment of the present invention is a space provided to stabilize the airflow in the flow path between the hot air introduction port 10 and the hot air supply port 6. Specifically, the space refers to, for example, the space between the hot air introduction port 10 and the partition plate 14, the space between the hot air introduction port 10 and the perforated plate 13, the space between the partition plate 14 and the perforated plate 13, or the space between the perforated plates 13. Among them, a stabilization chamber directly connected to the hot air introduction port 10 is defined as a first stabilization chamber 20. The hot air supply nozzle shown in FIG. 3 and FIG. 4 is similar to the hot air supply nozzle shown in FIG. 2 in that a plurality of perforated plates are disposed, but is different from the hot air supply nozzle shown in FIG. 2 in that the partition plate 14 different from that shown in FIG. 2 is used and further in that a plurality of cylindrical bodies 16 are connected to the upstream side surface of the partition plate 14 in the hot air flow path, the surface being positioned in the first stabilization chamber 20. Hereinafter, the partition plate 14 and the cylindrical body 16 will be described in detail.

The partition plate 14 is not made of a perforated material such as punching metal or honeycomb but is made of a non-perforated plate member. The cylindrical body 16 is a member whose axis orientation as a cylinder is an orientation perpendicular to the longitudinal axis of the hot air supply nozzle (an orientation along the height of the oxidation oven). Assuming that the cylindrical body 16 is cut along a plane perpendicular to the axis orientation as a cylinder, and the cross-sectional shape is a cross-sectional shape of the cylindrical body 16, the cross-sectional shape of the cylindrical body 16 is, for example, a polygonal shape such as a triangle or a quadrangle. In FIG. 4, the cross-sectional shape of the cylindrical body 16 is a quadrangle. Both ends of the cylindrical body 16 as a cylinder are openings 17. The length of the cylindrical body 16 (the length along the height of the oxidation oven) is smaller than the height of the hot air supply nozzle 5 along the height of the nozzle, so that a space is formed between the walls of the stabilization chamber 15 on both end sides along the height of the nozzle and the openings 17 of the cylindrical body 16, and the hot air supplied from the hot air introduction port 10 can flow from the space into the cylindrical body 16 through the openings 17. The plurality of cylindrical bodies 16 are connected along the nozzle longitudinal axis on the partition plate 14. In the cylindrical body 16, a member that is perforated and air-permeable, such as a punching metal or a net (mesh), may be disposed on the opening plane of the opening 17. The orientation of the plane formed by the opening 17 is not particularly limited, but it is preferable that the plane is substantially parallel to the nozzle longitudinal axis and substantially perpendicular to the partition plate 14. Note that "substantially parallel to the nozzle longitudinal axis" refers to an orientation within a range of ±5.0° with respect to the longitudinal axis of the nozzle, and "substantially perpendicular to the partition plate 14" refers to an orientation within a range of ±5.0° with respect to the axis perpendicular to the partition plate 14.

Figure 5:
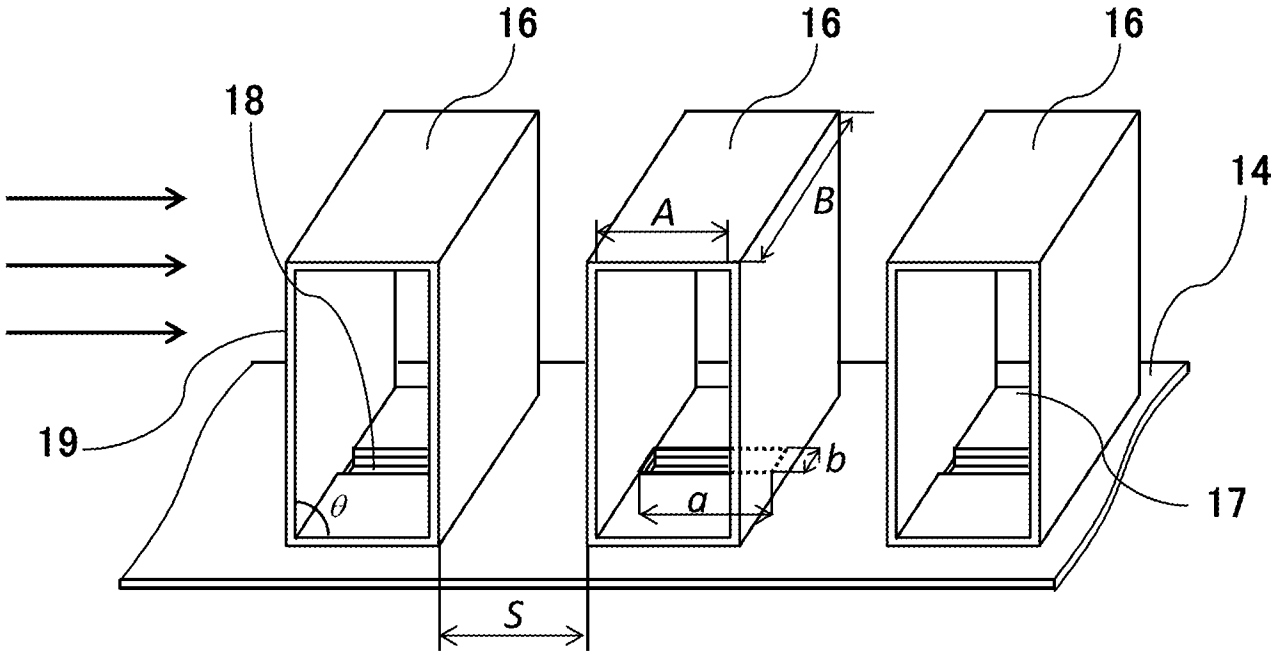
FIG. 5 is a perspective view showing an example of a configuration and disposition of cylindrical bodies.

FIG. 5 is a view for describing the internal configuration of the cylindrical body 16 and shows the partition plate 14 and the cylindrical body 16. In FIG. 5, the cylindrical body 16 is provided in the first stabilization chamber 20 directly connected to the hot air introduction port 10. In FIG. 5, the arrows indicate a flow direction of gas supplied from the hot air introduction port 10 to the first stabilization chamber 20. For convenience of illustration of the interior of the cylindrical body 16, the cylindrical body 16 in FIG. 5 is depicted as having a greater height than that shown in FIG. 4. However, the height of the cylindrical body 16 can be appropriately set as long as the cylindrical body 16 can be accommodated in the first stabilization chamber 20 or another stabilization chamber 15, and the effect of the present invention can be exerted regardless of whether the cylindrical body 16 as shown in FIG. 4 is used or the cylindrical body 16 having a height as shown in FIG. 5 is used. Inside the cylindrical body 16, a gas flow hole 18 is formed at a position along the longitudinal center line of the hot air supply nozzle 5 so as to penetrate through surfaces where the cylindrical body 16 and the partition plate 14 are in contact with each other, that is, both the bottom surface of the cylindrical body 16 and the partition plate 14. No flow hole is formed in the partition plate 14 at a position where the cylindrical body 16 is not provided. As a result, in the hot air supply nozzle 5, hot air supplied from the hot air introduction port 10 to the first stabilization chamber 20 flows into the cylindrical body 16 through the openings 17 of each cylindrical body 16, flows into the next stabilization chamber through the gas flow hole 18, and finally blows out from the hot air supply port 6 to the outside of the hot air supply nozzle 5.

Since the gas flow hole 18 is provided for each cylindrical body 16, a plurality of gas flow holes 18 are opened along the nozzle longitudinal axis as a whole of the partition plate 14. In this case, it is preferable that the gas flow holes 18 are uniformly opened along the nozzle longitudinal axis. Therefore, it is preferable that the cylindrical bodies 16 are continuously disposed on the partition plate 14 while being in contact with each other or are disposed at equal intervals along the nozzle longitudinal axis.

Figure 6:
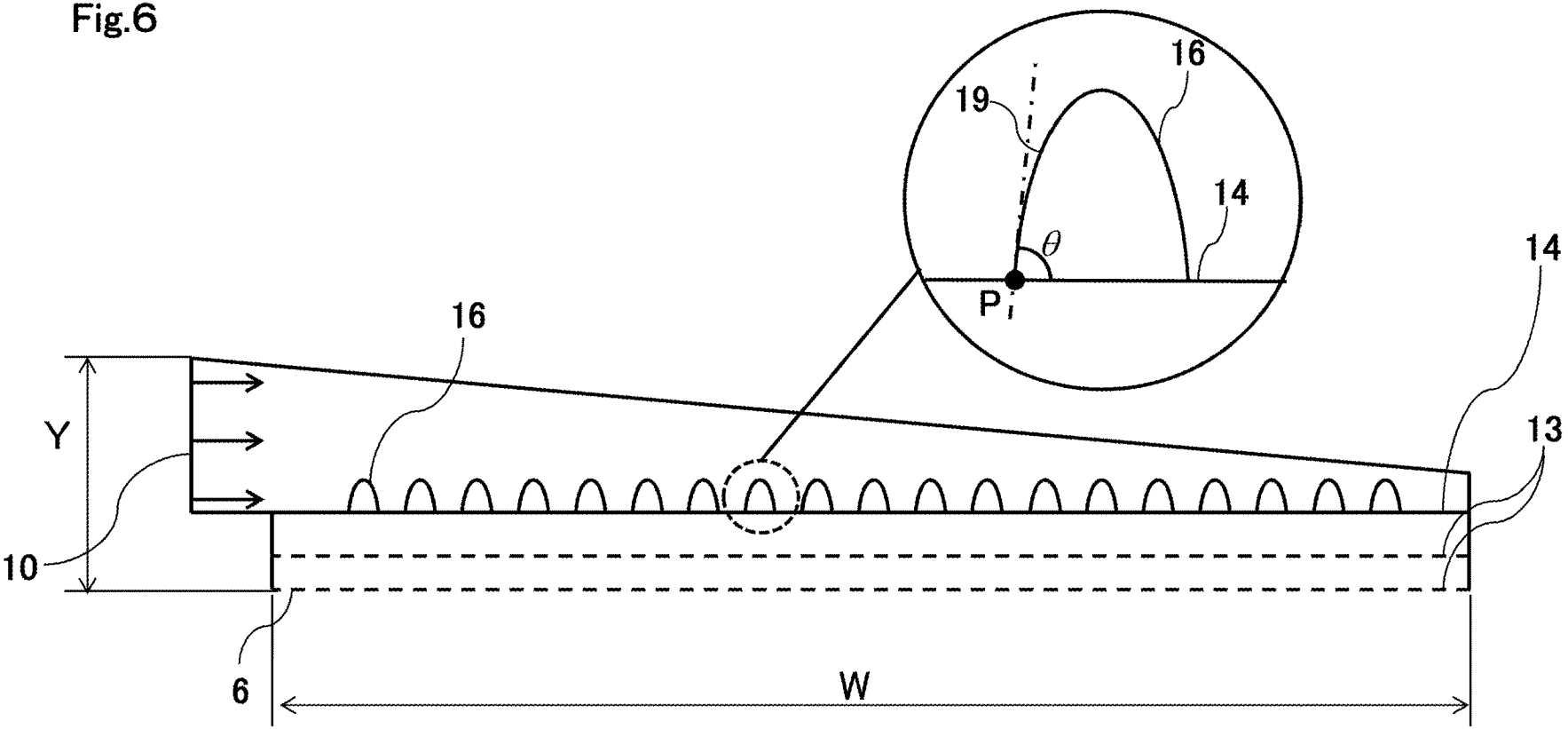
FIG. 6 is a cross-sectional view showing another example of the hot air supply nozzle.

In the hot air supply nozzle 5 of the present embodiment, each cylindrical body 16 has two walls rising from the partition plate 14. Of the walls, a wall 19 is on the side close to the hot air introduction port 10, and as an internal angle in the cross-sectional shape of the cylindrical body 16, an angle θ formed by the wall 19 and the partition plate 14 is required to be in a range of 60° or more and 110° or less and is preferably 75° or more and 95° or less. However, when the wall 19 on the side close to the hot air introduction port 10 is not in linear contact with the partition plate 14, such as when the cross section of the cylindrical body 16 is a curved surface, the angle θ is defined by an angle of a tangent (indicated by a one-dot chain line in FIG. 6) at a contact point P between the wall 19 on the side close to the hot air introduction port 10 and the partition plate 14 as shown in FIG. 6. According to the study of the present inventors, as will be apparent from Examples described later, when the angle θ formed by the wall 19 and the partition plate 14 is within the above angle range, the speed distribution of the hot air blown out from the hot air supply port 6 becomes uniform over the entire length along the nozzle longitudinal axis. Thereby, heat removal performance by hot air in the oxidation oven becomes uniform, so that not only an oxidized fiber bundle having uniform physical properties can be obtained, but also swinging of the fiber bundle caused by non-uniform air speed distribution can be reduced, which enables a higher quality oxidized fiber bundle to be obtained. In particular, in the center-to-end hot air system as shown in FIG. 1, since the hot air supply nozzle 5 is disposed at the center of the traveling path of the fiber bundle in the heat treatment oven, that is, at the center between the guide rollers 4, the sag amount of the acrylic fiber bundle 2 is maximized. Therefore, it is expected that the swing of the fiber bundle becomes the largest in the oxidation oven length, but the swing of the acrylic fiber bundle 2 at this position can be reduced by setting the angle θ within the above-described range.

In the example described above, the cylindrical body 16 is provided on the downstream side of the first stabilization chamber 20, but the stabilization chamber in which the cylindrical body 16 is provided is not necessarily limited to the first stabilization chamber. However, the most expected flow rectification effect by providing the cylindrical body 16 is a case where the partition plate 14 and the cylindrical body 16 connected to the partition plate 14 are provided in the first stabilization chamber. When the partition plate 14 and the cylindrical body 16 are provided in the first stabilization chamber, it is not always necessary to provide another stabilization chamber in the hot air supply nozzle 5, and it is also possible to employ a configuration in which the partition plate 14 itself is used as the hot air supply port 6, and hot air flowing out from the gas flow hole 18 is supplied into the oxidation oven as it is. However, from the viewpoint of controllability for the hot air blown out from the hot air supply port 6, it is preferable to provide two or more stabilization chambers including a stabilization chamber provided with the cylindrical body 16.

Figure 7:
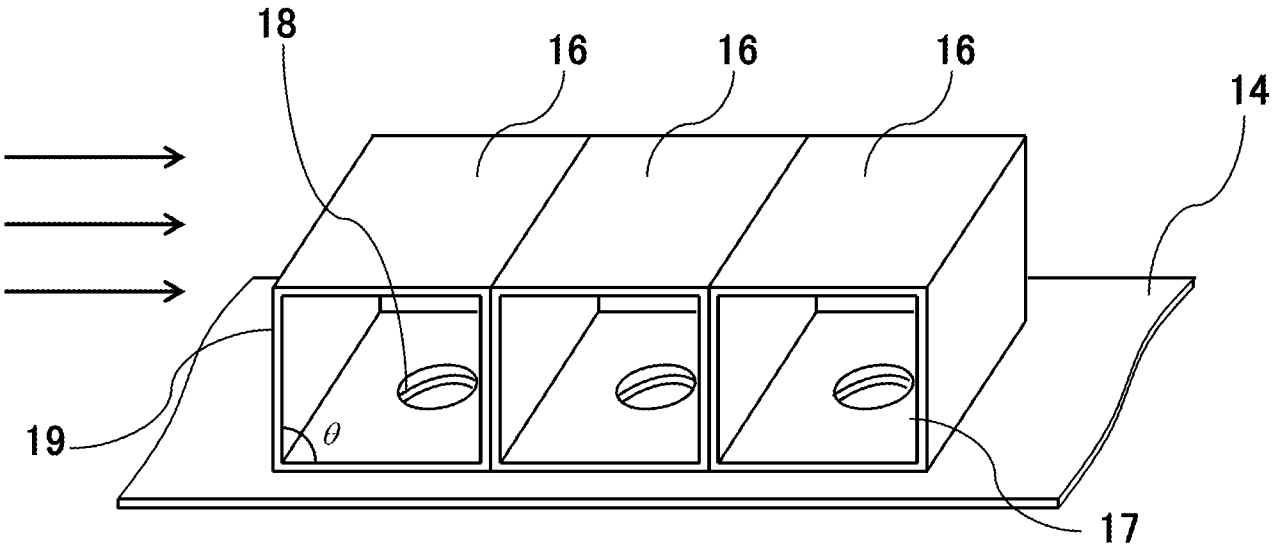
FIG. 7 is a perspective view showing another example of a configuration and disposition of cylindrical bodies.

In FIG. 3, FIG. 4, and FIG. 5, a plurality of the cylindrical bodies 16 having a quadrangular cross section are separated from each other and connected to the partition plate 14, but the configuration and disposition of the cylindrical bodies 16 are not limited thereto. FIG. 7 shows another example of a configuration and disposition of the cylindrical bodies 16. In the configuration shown in FIG. 7, a plurality of the cylindrical bodies 16 each having a quadrangular cross-sectional shape are connected onto the partition plate 14 so as to be in contact with each other along the nozzle longitudinal axis. The gas flow hole 18 is formed in a circular shape substantially at the center of the bottom surface of the cylindrical body 16, and the diameter of the gas flow hole 18 is smaller than the length along the nozzle longitudinal axis on the bottom surface of the cylindrical body 16. Also in the cylindrical body 16 shown in FIG. 7, the angle θ is required to be 60° or more and 110° or less and is preferably 75° or more and 95° or less, the angle θ being formed by the partition plate 14 and the wall 19 rising from the partition plate 14 and being one of the walls of the cylindrical body 16 and on the hot air introduction port 10 side (when the wall 19 on the side close to the hot air introduction port 10 is not in linear contact with the partition plate 14, such as when the cross section of the cylindrical body 16 is a curved surface, the angle θ is an angle of the tangent at the contact point P between the wall 19 on the side close to the hot air introduction port 10 and the partition plate 14).

Figure 8:
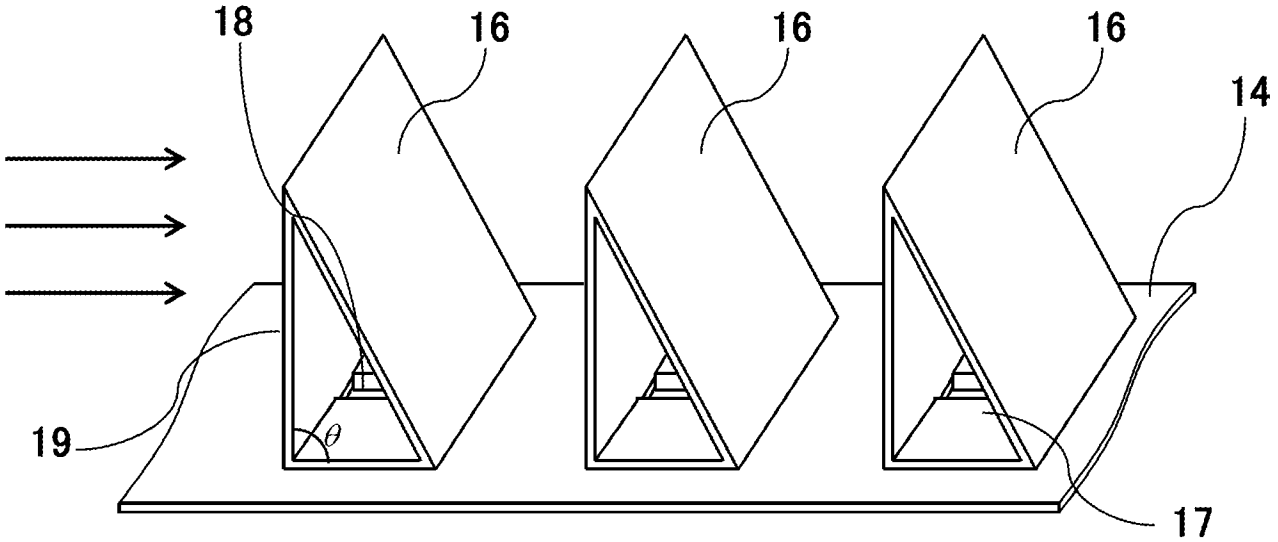
FIG. 8 is a perspective view showing still another example of a configuration and disposition of cylindrical bodies.

FIG. 8 shows still another example of a configuration and disposition of the cylindrical bodies 16. The configuration shown in FIG. 8 is such that the cross-sectional shape of the cylindrical body 16 in the configuration shown in FIG. 5 is changed from the quadrangle to a triangle. Also in the cylindrical body 16 shown in FIG. 8, the angle θ is required to be 60° or more and 110° or less and is preferably 75° or more and 95° or less, the angle θ being formed by the partition plate 14 and the wall 19 rising from the partition plate 14, the wall 19 being one of the walls of the cylindrical body 16 and on the hot air introduction port 10 side (when the wall 19 on the side close to the hot air introduction port 10 is not in linear contact with the partition plate 14, such as when the cross section of the cylindrical body 16 is a curved surface, the angle θ is an angle of the tangent at the contact point P between the wall 19 on the side close to the hot air introduction port 10 and the partition plate 14).

Figure 9:
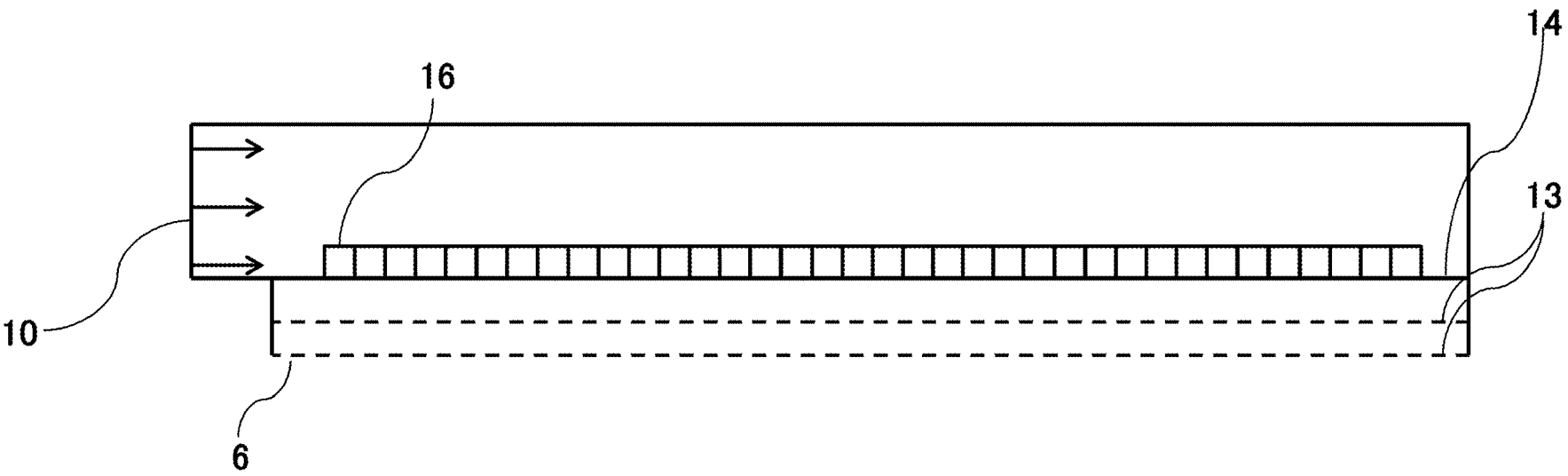
FIG. 9 is a cross-sectional view showing still another example of the hot air supply nozzle.

Next, a hot air supply nozzle according to another embodiment of the present invention will be described. In the hot air supply nozzle 5 of the above-described embodiment, the first stabilization chamber 20 directly connected to the hot air introduction port 10 is formed in a tapered shape in which the flow path width decreases along the nozzle longitudinal axis as viewed from the hot air introduction port 10 side. However, in an embodiment of the present invention, the shape of the first stabilization chamber 20 is not limited to the tapered shape. The hot air supply nozzle 5 shown in FIG. 9 has substantially the same configuration as the hot air supply nozzle 5 shown in FIG. 3 and FIG. 4 but is different from the hot air supply nozzle 5 shown in FIG. 3 and FIG. 4 in that the hot air supply nozzle 5 includes a first stabilization chamber having a constant flow path width along the nozzle longitudinal axis as viewed from the hot air introduction port 10 side. In addition, similarly to the one shown in FIG. 7, a plurality of adjacent cylindrical bodies 16 are provided so as to be in contact with each other.

In the hot air supply nozzle according to an embodiment of the present invention described above, when the total length of the hot air supply nozzle along the longitudinal axis is W and the nozzle length in the traveling direction of the fiber bundle is Y as shown in FIG. 4, Y/W is preferably 0.25 or less. As the total length W of the nozzle along the longitudinal axis is longer, it is necessary to perform flow rectification by disposing more stabilization chambers. However, as the nozzle length Y is therefore longer, a space in which hot air does not flow is increased in a space sandwiched between the nozzles that are each provided for each of the fiber bundles traveling in multiple stages, and the risk of occurrence of runaway reaction caused by insufficient heat removal for the fiber bundle in which an exothermic reaction occurs is increased. However, in the present invention, Y/W can be set to 0.25 or less by providing the stabilization chambers, the partition plate, and the cylindrical bodies as described above.

The shape of the gas flow hole 18 provided so as to penetrate through both the bottom surface of the cylindrical body 16 and the partition plate 14 is not particularly limited as long as the gas flow hole 18 communicates with the upstream-side stabilization chamber and the downstream-side stabilization chamber or the hot air supply port 6, but the equivalent diameter De of the gas flow hole 18 is preferably 20 mm or more. Further, the shape is preferably a slit-shaped extending along the nozzle longitudinal axis, and more preferably, the opening ratio S1/S2 is 0.85 or less, when the opening area of the gas flow hole 18 is S1 and the area of the surface of the cylindrical body 16, the surface being in contact with the partition plate 14, is S2, for one cylindrical body.

Here, the "equivalent diameter" indicates how much diameter a circular flow path is equivalent to a rectangular flow path and is defined by the following equation.

$$De = 1.3\left[\frac{(ab)^{0.625}}{(a+b)^{0.25}}\right] \quad \text{[Equation 1]}$$

Here, as shown in FIG. 5, a and b are lengths of a long side and a short side of the gas flow hole 18 that is rectangular, respectively (in a case of a square, a=b).

In the example of FIG. 5, a side along the longitudinal axis of the nozzle is a long side a, and a side along the height of the nozzle is a short side b. However, the present invention is not limited to this case, and conversely, they may be appropriately designed so that a side along the longitudinal axis of the nozzle is the short side b, and a side along the height is the long side a. In addition, the opening area S1 of the gas flow hole in the above case is a×b, and the area S2 of the surface of the cylindrical body in contact with the partition plate is A×B.

By setting the equivalent diameter De to 20 mm or more, it is possible to prevent dust generated by volatilization of the silicone based oil agent due to high heat of the oxidation treatment from clogging and blocking the gas flow holes 18 and to perform long-term stable operation of the oxidation oven, and further, by setting the opening ratio S1/S2 to 0.85 or less, a higher flow rectification effect can be expected.

In the oxidation oven of the present invention, in order to control the reaction of the fiber bundle that generates heat by removing the heat by hot air supplied from the nozzle, the blowout speed of hot air from the hot air supply nozzle is preferably in a range of 1.0 m/s or more and 15.0 m/s or less, and more preferably in a range of 1.0 m/s or more and 9.0 m/s or less.

The oxidized fiber bundle manufactured in the oxidation oven including the hot air supply nozzle described above is pre-carbonized at a maximum temperature of 300 to 1,000° C. in an inert gas, for example. In this way, a pre-carbonized fiber bundle is manufactured, and further carbonized at a maximum temperature of 1,000 to 2,000° C. in an inert gas to manufacture a carbon fiber bundle.

The maximum temperature of the inert gas in the pre-carbonization treatment is preferably 550 to 800° C. As the inert gas filling the inside of a pre-carbonization oven, a known inert gas such as nitrogen, argon, or helium can be employed, but nitrogen is preferable from the viewpoint of economic efficiency.

The pre-carbonized fiber obtained by the pre-carbonization treatment are then fed into a carbonization oven and carbonized. In order to improve the mechanical properties of the carbon fiber, it is preferable to perform the carbonization treatment at a maximum temperature of 1,200 to 2,000° C. in an inert gas.

As the inert gas filling the inside of a carbonization oven, a known inert gas such as nitrogen, argon, or helium can be employed, but nitrogen is preferable from the viewpoint of economic efficiency.

A sizing agent may be applied to the carbon fiber bundle thus obtained in order to improve handleability and affinity with a matrix resin. The type of the sizing agent is not particularly limited as long as desired properties can be obtained, and examples thereof include sizing agents containing an epoxy resin, a polyether resin, an epoxy-modified polyurethane resin, or a polyester resin as a main component. A known method can be used to apply the sizing agent.

Further, the carbon fiber bundle may be subjected to an electrolytic oxidation treatment or an oxidation treatment for the purpose of improving affinity with a fiber-reinforced composite material matrix resin and adhesiveness thereto, if necessary.

The acrylic fiber bundle used as a fiber bundle to be heat-treated in the apparatus for manufacturing an oxidized fiber bundle of the present invention is preferably made of acryl fibers of 100% acrylonitrile or acryl copolymer fibers containing 90 mol % or more acrylonitrile. A copolymerization component in the acryl copolymer fiber is preferably acrylic acid, methacrylic acid, itaconic acid, and alkali metal salts thereof, ammonium metal salts, acrylamide, methyl acrylate, and the like, but the chemical properties, physical properties, dimensions, and the like of the acrylic fiber bundle are not particularly limited.

EXAMPLES

Hereinafter, the present invention will be described more specifically with reference to the drawings by way of Examples, but the present invention is not limited thereto. Note that the air speed in each Example and Comparative Example was measured by using an Anemomaster high-temperature anemometer Model 6162 manufactured by KANOMAX Corporation and inserting a measurement probe from a measurement hole (not illustrated) on the side of the heat treatment chamber 3. The measurement points were seven points along the longitudinal axis including the center of the nozzle length along the longitudinal axis at a position 200 mm downstream from the hot air supply port 6, and the average value of 30 measurement values obtained every 1 second was calculated at each measurement point and used as the air speed. The air speed variation was calculated from the following equation using the maximum value Vmax, the minimum value Vmin, and the average value Vave of the seven air speed values measured and calculated at each measurement point.

$$(\text{Variation in air speed})=[\{(V\max-V\min)\times 0.5\}/Vave]\times 100$$

Table 1 and table 2 show the evaluation results for the process stability and quality of the respective Examples and Comparative Examples according to the following criteria.

(Process Stability)

A: An extremely good level at which trouble such as fiber mixing or fiber bundle breakage occurs zero times on average per day.

B: A level at which trouble such as fiber mixing or fiber bundle breakage occurs about several times on average per day and continuous operation can be kept sufficiently.

F: A level at which trouble such as fiber mixing or fiber bundle breakage occurs several tens of times on average per day and continuous operation cannot be kept.

(Quality)

A: A level at which the number of fuzzes of 10 mm or more that can be visually confirmed on the fiber bundle after the oxidation process is several/m or less on average, and the fluff quality does not affect the passability in the process and the high-order processability as a product at all.

B: A level at which the number of fuzzes of 10 mm or more that can be visually confirmed on the fiber bundle after the oxidation process is 10/m or less on average, and the fluff quality has almost no influence on the passability in the process and the high-order processability as a product.

F: A level at which the number of fuzzes of 10 mm or more that can be visually confirmed on the fiber bundle after the oxidation process is more than several tens/m on average, and the fluff quality adversely affects the passability in the process and the high-order processability as a product.

Example 1

FIG. 1 is a schematic configuration diagram showing an example when the heat treatment oven according to an embodiment of the present invention is used as an oxidation oven for carbon fiber manufacturing. At centers between the guide rollers 4 on both sides of the oxidation oven 1, the hot air supply nozzles 5 are installed above and below the acrylic fiber bundle 2 traveling in the oxidation oven 1. The hot air supply nozzle 5 was provided with the hot air supply port 6 in a traveling direction of the fiber bundle or in a direction opposite to the traveling direction of the fiber bundle.

For the acrylic fiber bundle 2 that travels in the oven, 100 fiber bundles each composed of 20,000 single fibers having a single fiber fineness of 0.11 tex were aligned and heat-treated in the oxidation oven 1 to obtain an oxidized fiber bundle. The horizontal distance L' between the guide rollers 4 on both sides of the heat treatment chamber 3 of the oxidation oven 1 was 15 m, the guide rollers 4 were groove rollers, and the pitch interval was 8 mm. In this case, the temperature of oxidizing gas in the heat treatment chamber 3 of the oxidation oven 1 was 240 to 280° C., and the horizontal air speed of the oxidizing gas supplied from the hot air supply port 6 was 3.0 m/s. The traveling speed of the fiber bundle was adjusted in a range of 1 to 15 m/min in accordance with the oxidation oven length L so that the oxidation treatment time was sufficiently taken, and the process tension was adjusted in a range of 0.5 to 2.5 gf/tex ($5.0\times10^{-3}$ to $2.5\times10^{-2}$ N/tex).

The obtained oxidized fiber bundle was then carbonized at a maximum temperature of 700° C. in a pre-carbonization oven, and then fired at a maximum temperature of 1,400° C. in a carbonization oven, and a sizing agent was applied after electrolytic surface treatment to obtain a carbon fiber bundle.

The configuration of the hot air supply nozzle 5 in the oxidation oven 1 was as shown in FIGS. 3, 4, and 5, and the nozzle length Y in the traveling direction of the fiber bundle was 450 mm, and the total length W along the nozzle longitudinal axis was 3000 mm. The ratio Y/W of the nozzle length to the length along the nozzle longitudinal axis is 0.15. A total of three stabilization chambers were provided, the cylindrical bodies 16 and the partition plate 14 were arranged in the first stabilization chamber 20, and a total of two perforated plates having a hole diameter of 20 mm and an opening ratio of 30% were each provided in each of the subsequent stabilization chambers. The cylindrical bodies 16 were connected to the partition plate 14 along the longitudinal axis of the nozzle, and the interval S between the adjacent cylindrical bodies was 10 mm. The internal angle formed by the partition plate 14 and the wall 19 that is one of two side walls rising from the partition plate 14 and on the hot air introduction port 10 side was θ, and the internal angle formed by the partition plate and the wall on the side other than the hot air introduction port side was 90°. The gas flow hole 18 was rectangular, and the equivalent diameter was 24 mm. Then, the internal angle θ was changed, and the air speed variation at a position 200 mm downstream from the hot air supply port 6 was evaluated. The results are shown in Table 1.

TABLE 1-1

| | | | | | |
|---|---|---|---|---|---|
| Equipment conditions | Span between rollers [m] | 15.0 | 15.0 | 15.0 | 15.0 |
| | Groove pitch [mm] | 8.0 | 8.0 | 8.0 | 8.0 |
| | Supplied air speed [m/s] | 3.0 | 3.0 | 3.0 | 3.0 |
| Nozzle configuration | Nozzle length Y [mm] | 450 | 450 | 450 | 450 |
| | Nozzle width W [mm] | 3000 | 3000 | 3000 | 3000 |
| | Distance between cylindrical bodies S [mm] | 10 | 10 | 10 | 10 |
| | Equivalent diameter De [mm] | 24 | 24 | 24 | 24 |
| | Internal angle of cylindrical body θ [°] | 60 | 70 | 75 | 80 |
| Variation in air speed [%] | | 24.0 | 21.5 | 14.0 | 14.7 |
| Process stability | | B | B | A | A |
| Quality | | B | B | A | A |

TABLE 1-2

| | | | | | |
|---|---|---|---|---|---|
| Equipment conditions | Span between rollers [m] | 15.0 | 15.0 | 15.0 | 15.0 |
| | Groove pitch [mm] | 8.0 | 8.0 | 8.0 | 8.0 |
| | Supplied air speed [m/s] | 3.0 | 3.0 | 3.0 | 3.0 |
| Nozzle configuration | Nozzle length Y [mm] | 450 | 450 | 450 | 450 |
| | Nozzle width W [mm] | 3000 | 3000 | 3000 | 3000 |
| | Distance between cylindrical bodies S [mm] | 10 | 10 | 10 | 10 |
| | Equivalent diameter De [mm] | 24 | 24 | 24 | 24 |
| | Internal angle of cylindrical body θ [°] | 90 | 95 | 100 | 110 |
| Variation in air speed [%] | | 14.0 | 14.5 | 18.2 | 21.7 |
| Process stability | | A | A | B | B |
| Quality | | A | A | B | B |

From Table 1, when the internal angle θ was 60° or more and 110° or less, the air speed variation was ±15% or more and ±25% or less, and both the quality and the process stability were at a satisfactory level. Further preferably, when the internal angle θ was 75° or more and 95° or less, the air speed variation was less than ±15%, and it was found that an oxidized fiber bundle and a carbon fiber bundle can be obtained with high quality and higher process stability level.

Example 2

The procedure similar to that of Example 1 was carried out except that, in the hot air supply nozzle 5 shown in FIGS. 3, 4, and 5, the internal angle θ was 90°, and the interval S between the adjacent cylindrical bodies was reduced to 5 mm. In this case, the air speed variation was 8.6%. Under the above conditions, fiber mixing, fiber bundle breakage, or the like due to contact between the fiber bundles did not occur at all during the oxidation treatment of the acryl fiber bundle, and an oxidized fiber bundle was acquired with extremely good process stability. In addition, the obtained oxidized fiber bundle and carbon fiber bundle were visually checked, and the result showed that the quality was extremely good without fuzz or the like.

Example 3

The procedure similar to that of Example 2 was carried out except that an interval S between adjacent cylindrical bodies was 0 mm. In other words, in this configuration, all the cylindrical bodies are connected to the partition plate so that the cylindrical bodies are in contact with each other, and the gas flow hole 18 is a slit extending along the longitudinal axis of the nozzle. In this case, the air speed variation was 8.2%. Under the above conditions, fiber mixing, fiber bundle breakage, or the like due to contact between the fiber bundles did not occur at all during the oxidation treatment of the acryl fiber bundle, and an oxidized fiber bundle was acquired with extremely good process stability. In addition, the obtained oxidized fiber bundle and carbon fiber bundle were visually checked, and the result showed that the quality was extremely good without fuzz or the like.

Example 4

The procedure similar to that of Example 1 was carried out except that, in the hot air supply nozzle 5, the internal angle θ was 90° and the air speed of the oxidizing gas supplied from the hot air supply port 6 in the horizontal direction was 9.0 m/s. In this case, the air speed variation was 16.5%. Under the above conditions, fiber mixing, fiber bundle breakage, or the like due to contact between the fiber bundles were less during the oxidation treatment of the acryl fiber bundle, and an oxidized fiber bundle was acquired with good process stability. In addition, the obtained oxidized fiber bundle and carbon fiber bundle were visually checked, and the result showed that the quality was good with less fuzz or the like.

Example 5

The procedure similar to that of Example 1 was carried out except that the equivalent diameter of the gas flow hole 18 was 6 mm. In this case, the air speed variation was 10.1%. Under the above conditions, fiber mixing, fiber bundle breakage, or the like due to contact between the fiber bundles during the oxidation treatment did not occur at the beginning of the operation, but the yarn breakage frequency increased to about several times on average per day as the continuous operation was performed. The perforated plate of the nozzle was checked after the operation, and it was confirmed that dust generated by volatilization of a silicone based oil agent clogged the gas flow holes 18. In addition, the obtained oxidized fiber bundle and carbon fiber bundle were visually checked, and the result showed that the quality was good with less fuzz or the like.

Example 6

The procedure similar to that of Example 1 was carried out except that the nozzle length Y was 900 mm. In this case, the air speed variation was as good as 12.2%. Under the above conditions, during the oxidation treatment of the acryl fiber bundle, fiber bundle breakage considered to be caused by the temperature rise of the fiber bundle in the space sandwiched between the nozzles through which the fiber bundle travels occurred several times on average per day, but an oxidized fiber bundle was acquired with good process stability. In addition, the obtained oxidized fiber bundle and carbon fiber bundle were visually checked, and the result showed that the quality was good with less fuzz or the like.

Comparative Example 1

The procedure similar to that of Example 1 was carried out except that the internal angle θ was 55° in the hot air supply nozzle 5. In this case, the air speed variation was 29.2%. Under the above conditions, fiber mixing, fiber bundle breakage, or the like due to contact between the fiber bundles were less during the oxidation treatment of the acrylic fiber bundle, and an oxidized fiber bundle was acquired with good process stability. However, the obtained oxidized fiber bundle and carbon fiber bundle were visually checked, and the result showed that there were many fuzzes and the like, and the quality was poor.

Comparative Example 2

The procedure similar to that of Example 1 was carried out except that the internal angle θ was 45° in the hot air supply nozzle 5. In this case, the measured air speed variation was 32.7%. Under the above conditions, fiber mixing, fiber bundle breakage, or the like due to contact between the fiber bundles frequently occurred during the oxidation treatment of the acryl fiber bundle, and it was difficult to continue the operation. In addition, the obtained oxidized fiber bundle and carbon fiber bundle were visually checked, and the result showed that there were many fuzzes and the like, and the quality was poor.

Comparative Example 3

The procedure similar to that of Example 1 was carried out except that the internal angle θ was 120° in the hot air supply nozzle 5. In this case, the measured air speed variation was 26.4%. Under the above conditions, fiber mixing, fiber bundle breakage, or the like due to contact between the fiber bundles were less during the oxidation treatment of the acrylic fiber bundle, and an oxidized fiber bundle was acquired with good process stability. However, the obtained oxidized fiber bundle and carbon fiber bundle were visually checked, and the result showed that there were many fuzzes and the like, and the quality was poor.

Comparative Example 4

As a comparative example, an oxidized fiber bundle was acquired in the oxidation oven 1 including a hot air supply nozzle 5 having a configuration shown in FIG. 2, which is a conventional technique. In a first region (corresponding to the first stabilization chamber 20 in FIG. 3) connected to the hot air introduction port 10, not the partition plate 14 but the perforated plate 13 having a hole diameter of 20 mm and an opening ratio of 30% was provided, and not the cylindrical bodies 16 but two guide blades 11 were disposed. Further, the flow rectification plate 12 was disposed on the perforated plate 13 that is on the most downstream side of the hot air flow path and becomes the hot air supply port 6. The procedure similar to that of Example 1 was carried out except for the above points. In this case, the air speed variation was 30.1%. Under the above conditions, fiber mixing, fiber bundle breakage, or the like due to contact between the fiber bundles frequently occurred during the oxidation treatment of the acryl fiber bundle, and it was difficult to continue the operation. In addition, the obtained oxidized fiber bundle and carbon fiber bundle were visually checked, and the result showed that there were many fuzzes and the like, and the quality was poor.

TABLE 2-1

| | | Example 1 | Example 2 | Example 3 | Example 4 | Example 5 | Example 6 |
|---|---|---|---|---|---|---|---|
| Equipment conditions | Span between rollers [m] | 15.0 | 15.0 | 15.0 | 15.0 | 15.0 | 15.0 |
| | Groove pitch [mm] | 8.0 | 8.0 | 8.0 | 8.0 | 8.0 | 8.0 |
| | Supplied surface air speed [m/s] | 3.0 | 3.0 | 3.0 | 9.0 | 3.0 | 3.0 |
| Nozzle | Nozzle length Y [mm] | 450 | 450 | 450 | 450 | 450 | 900 |
| | Nozzle width W [mm] | 3000 | 3000 | 3000 | 3000 | 3000 | 3000 |
| | Distance between cylindrical bodies S [mm] | 10 | 5 | 0 | 10 | 10 | 10 |
| | Equivalent diameter De [mm] | 24 | 24 | 24 | 24 | 6 | 24 |
| | Internal angle of cylindrical body θ [°] | 90 | 90 | 90 | 90 | 90 | 90 |
| | Guide blade | No | No | No | No | No | No |
| | Flow rectification plate | No | No | No | No | No | No |
| Variation in air speed [%] | | 14.0 | 8.6 | 8.2 | 16.5 | 10.1 | 12.2 |
| Process stability | | A | A | A | B | B | B |
| Quality | | A | A | A | B | B | B |

TABLE 2-2

| | | Comparative Example 1 | Comparative Example 2 | Comparative Example 3 | Comparative Example 4 |
|---|---|---|---|---|---|
| Equipment conditions | Span between rollers [m] | 15.0 | 15.0 | 15.0 | 15.0 |
| | Groove pitch [mm] | 8.0 | 8.0 | 8.0 | 8.0 |
| | Supplied surface air speed [m/s] | 3.0 | 3.0 | 3.0 | 3.0 |
| Nozzle | Nozzle length Y [mm] | 450 | 450 | 450 | 450 |
| | Nozzle width W [mm] | 3000 | 3000 | 3000 | 3000 |
| | Distance between cylindrical bodies S [mm] | 10 | 10 | 10 | — |
| | Equivalent diameter De [mm] | 24 | 24 | 24 | — |
| | Internal angle of cylindrical body θ [°] | 55 | 45 | 120 | — |
| | Guide blade | No | No | No | Yes |
| | Flow rectification plate | No | No | No | Yes |
| Variation in air speed [%] | | 29.2 | 32.7 | 26.4 | 30.1 |
| Process stability | | B | F | B | F |
| Quality | | F | F | F | F |

The present invention can be suitably used for manufacturing of an oxidized fiber bundle and carbon fiber bundle, and the oxidized fiber bundle and carbon fiber bundle obtained by the present invention can be suitably applied to aircraft applications, industrial applications such as pressure vessels and windmills, sports applications such as golf shafts, and the like, but the application range is not limited thereto.

DESCRIPTION OF REFERENCE SIGNS

1: Oxidation oven
2: Acrylic fiber bundle
3: Heat treatment chamber
4: Guide roller
5: Hot air supply nozzle
6: Hot air supply port
7: Hot air discharge port
8: Heater
9: Blower
10: Hot air introduction port
11: Guide blade
12: Flow rectification plate
13: Perforated plate
14: Partition plate
15: Stabilization chamber
16: Cylindrical body
17: Opening
18: Gas flow hole
19: Wall
20: First stabilization chamber
L: Oxidation oven length (effective oxidation length of one path)
L': Horizontal distance between guide rollers
X: Width of hot air introduction port
X': Flow path width divided by guide blade
Y: Nozzle length in traveling direction of fiber bundle
W: Total length of nozzle along longitudinal axis
De: Equivalent diameter of gas flow hole
S: Distance between adjacent cylindrical bodies
θ: Internal angle of cylindrical body
a: Long side of gas flow hole
b: Short side of gas flow hole
A: Long side of surface of cylindrical body in contact with partition plate
B: Short side of surface of cylindrical body in contact with partition plate
P: Contact point between wall on side close to hot air introduction port and partition plate
S1: Opening area of gas flow hole
S2: Area of surface of cylindrical body, the surface being in contact with partition plate

The invention claimed is:

1. An oxidation heat treatment oven comprising:

a heat treatment chamber configured to heat-treat a fiber bundle that is an aligned acrylic fiber bundle in an oxidizing atmosphere to form an oxidized fiber bundle;

a slit-shaped opening configured to take the fiber bundle in and out of the heat treatment chamber;

guide rollers installed at both ends of the heat treatment chamber and configured to turn the fiber bundle back;

a hot air supply nozzle that has a longitudinal axis along a width of the fiber bundle and that blows out hot air, in a direction substantially parallel to a traveling direction of the fiber bundle, above and/or below the fiber bundle traveling in the heat treatment chamber; and a suction nozzle configured to suck the hot air blown out from the hot air supply nozzle, wherein the hot air supply nozzle satisfies conditions (1) to (3) described below:

(1) The hot air supply nozzle comprises a hot air introduction port configured to supply hot air along the longitudinal axis of the hot air supply nozzle; a hot air supply port configured to blow out the hot air in the direction substantially parallel to the traveling direction of the fiber bundle; and one or more stabilization chambers located between the hot air introduction port and the hot air supply port, wherein the hot air introduction port and the hot air supply port communicate with each other via the one or more stabilization chambers;

(2) At least one of the stabilization chambers comprises a partition plate provided on a downstream side of a hot air flow path; a plurality of cylindrical bodies each having openings at both ends and connected to a surface of the partition plate on an upstream side of the hot air flow path such that an axis orientation of each of the cylindrical bodies is perpendicular to the longitudinal axis of the hot air supply nozzle; and a gas flow hole provided at a surface of the each of the cylindrical bodies in contact with the partition plate and configured to penetrate through the partition plate; and (3) In the cylindrical bodies, an angle θ formed by the partition plate and a wall that is one of walls rising from the partition plate and on a side close to the hot air introduction port is in a range of 60° or more and 110° or less as an internal angle in a cross-sectional shape of the cylindrical bodies.

2. The oxidation heat treatment oven according to claim 1, wherein the angle θ is in a range of 75° or more and 95° or less.

3. The oxidation heat treatment oven according to claim 1, wherein the stabilization chamber in which the plurality of cylindrical bodies are disposed is directly connected to the hot air introduction port.

4. The oxidation heat treatment oven according to claim 1, wherein, when a total length along the longitudinal axis of the hot air supply nozzle is W, and a nozzle length of the hot air supply nozzle along the traveling direction of the fiber bundle is Y, Y/W is 0.25 or less.

5. The oxidation heat treatment oven according to claim 1, wherein the gas flow hole has an equivalent diameter of 20 mm or more.

6. The oxidation heat treatment oven according to claim 1, wherein all the cylindrical bodies are configured to be in contact with each other and connected to the partition plate.

7. The oxidation heat treatment oven according to claim 1, wherein the hot air supply nozzle is disposed at a center of a traveling path of the fiber bundle in the heat treatment oven.

8. The oxidation heat treatment oven according to claim 1 wherein a plane formed by each of the openings of the cylindrical bodies is a plane substantially parallel to the longitudinal axis of the hot air supply nozzle and substantially perpendicular to the partition plate.

9. A method for manufacturing an oxidized fiber bundle by using the oxidation heat treatment oven according to claim 1 to manufacture the oxidized fiber bundle, the method comprising:

allowing an aligned acrylic fiber bundle to travel in the heat treatment chamber while turning the fiber bundle back to the heat treatment chamber with the guide rollers installed at both ends of the heat treatment chamber; and heat-treating the fiber bundle in the oxidizing atmosphere in the heat treatment chamber by blowing out hot air from the hot air supply nozzle, in a direction substantially parallel to the traveling direction of the fiber bundle, above and/or below the fiber bundle traveling in the heat treatment chamber while sucking the hot air from the suction nozzle.

10. The method for manufacturing an oxidized fiber bundle according to claim 9, wherein an air speed of the hot air blown out from the hot air supply nozzle is in a range of 1.0 m/s or more and 15.0 m/s or less.

11. A method for manufacturing a carbon fiber bundle, comprising:

pre-carbonizing an oxidized fiber bundle manufactured by the method for manufacturing an oxidized fiber bundle according to claim 9 at a maximum temperature of 300 to 1,000° C. in an inert gas to obtain a pre-carbonized fiber bundle; and then carbonizing the pre-carbonized fiber bundle at a maximum temperature of 1,000 to 2,000° C. in an inert gas.

* * * * *